US011333395B2

(12) United States Patent
Block et al.

(10) Patent No.: US 11,333,395 B2
(45) Date of Patent: May 17, 2022

(54) CONDENSATE REMOVAL SYSTEM FOR COLD-CLIMATE HEAT PUMPS

(71) Applicant: Steven Winter Associates, Inc., New York, NY (US)

(72) Inventors: Jason Block, Brooklyn, NY (US); Marc Zuluaga, Montclair, NJ (US)

(73) Assignee: Steven Winter Associates, Inc., New York, NY (US)

( * ) Notice: Subject to any disclaimer, the term of this patent is extended or adjusted under 35 U.S.C. 154(b) by 262 days.

(21) Appl. No.: 16/814,605

(22) Filed: Mar. 10, 2020

(65) Prior Publication Data

US 2020/0292215 A1 Sep. 17, 2020

Related U.S. Application Data

(60) Provisional application No. 62/816,567, filed on Mar. 11, 2019.

(51) Int. Cl.
*F24F 13/22* (2006.01)
*F24F 1/0057* (2019.01)

(52) U.S. Cl.
CPC ..... *F24F 13/222* (2013.01); *F24F 1/0057* (2019.02); *F24F 2013/227* (2013.01)

(58) Field of Classification Search
CPC ... F24F 13/222; F24F 2013/227; F24H 8/006; F28F 17/005
See application file for complete search history.

(56) References Cited

U.S. PATENT DOCUMENTS

| | | | | |
|---|---|---|---|---|
| 5,271,237 | A * | 12/1993 | Popelka | F24F 13/22 62/179 |
| 5,284,204 | A * | 2/1994 | Morgan | F16L 11/22 165/219 |
| 6,481,232 | B2 * | 11/2002 | Faqih | F24F 13/222 62/285 |
| 7,191,606 | B1 * | 3/2007 | Dwyer | F24F 13/222 62/150 |
| 8,475,603 | B2 * | 7/2013 | Kaiser | F24F 13/222 134/166 C |
| 9,139,365 | B2 * | 9/2015 | Andersen | B65G 11/02 |
| 9,459,016 | B1 * | 10/2016 | Kopp | F24F 6/043 |
| 10,378,780 | B2 * | 8/2019 | Kurosu | F24F 1/0057 |
| 11,209,187 | B2 * | 12/2021 | Jayarathne | F24D 5/00 |
| 2008/0011354 | A1 * | 1/2008 | Niece | E03C 1/044 137/1 |
| 2011/0192179 | A1 * | 8/2011 | Freije, III | F24F 5/0035 62/121 |

(Continued)

*Primary Examiner* — Christopher R Zerphey
(74) *Attorney, Agent, or Firm* — St Onge Steward Johnston and Reens LLC

(57) ABSTRACT

A system for managing drainage of heat pump coil condensate using a building's legacy heat piping infrastructure. The system includes a drainage pan that accumulates condensate and directs it into condensate piping. The condensate piping feeds the condensate into the building's legacy heat piping infrastructure, preferably after treating the condensate with a neutralizer to reduce its acidity. The system also includes a system control for monitoring the accumulated condensate levels and the status of the legacy heating system to determine when to open a flow control means allowing the condensate to drain from the condensate piping into the building's legacy heat piping infrastructure.

20 Claims, 9 Drawing Sheets

(56) References Cited

U.S. PATENT DOCUMENTS

| | | | | |
|---|---|---|---|---|
| 2012/0048257 | A1* | 3/2012 | Reifel | F24H 3/087<br>126/112 |
| 2017/0045282 | A1* | 2/2017 | Thornberry, Jr. | F24F 13/222 |
| 2017/0157527 | A1* | 6/2017 | Kopel | F28B 9/08 |
| 2021/0063046 | A1* | 3/2021 | Bush | B08B 3/02 |

* cited by examiner

CONDENSATE REMOVAL SYSTEM FOR COLD-CLIMATE HEAT PUMPS

FIELD OF THE INVENTION

This invention relates to building unit heating systems, specifically the use of cold-climate heat pump heating systems installed in buildings that originally were designed to use centralized heating systems distributing steam or hot water throughout the building.

BACKGROUND OF THE INVENTION

Steam central heating systems are among the first central heating systems of the industrial era. Steam central heating systems utilized steam that was distributed to the various rooms of the structure through piping to steam radiators where heat was released to the room. Over time, steam heating systems became less popular and hydronic hot water systems became the standard for new heating system installations. Hydronic hot water systems circulate hot water through piping to baseboard radiators or other terminal units.

Heat pump units have become more popular as the technology has steadily improved in past decades. Recently, cold-climate heat pump units have been brought to market that are effective in providing heating in cold weather climates, and are also highly energy efficient. In addition, commitments in many markets to decarbonize the electricity supply grid mean that electrically driven heat pumps allow for dramatic reductions in carbon footprint compared to legacy systems that burn fossil fuel on site. Consequently, owners of multi-floor buildings such as offices and apartment buildings have a motivation to replace the less-efficient steam and hydronic heating systems with electrically driven cold-climate heat pump units in order to reduce the heating costs and/or carbon footprint of a building. Heat pump systems also offer comfort and control benefits for occupants compared to legacy steam heating systems, resulting in yet another motivation for owners to install such systems. While in some cases a building owner may replace the entire heating system of the building with some form of heat pump system, in many cases it is not economical or convenient to do a complete heating system replacement. A more convenient and economic approach is to do a heating system makeover on an incremental or selective basis by the installation of heat pump systems that only serve a particular room, tenant space or portion of a building. These systems have an internal heating unit (typically wall mounted) that is connected to an external heat pump unit mounted on the exterior of the building envelope.

Cold-climate heat pumps have outdoor coils on which it is typical for condensation to form. In sub-freezing temperatures, this condensation can freeze. To prevent freezing, the systems must utilize a defrost function to melt the condensate from the coils, thereby keeping the system functioning optimally. This defrosting process may be achieved through a hot-gas bypass of the refrigerant, a separate heater, or some other means.

Water from condensation is a problem, particularly when a large water flow is generated during a defrost cycle. In order to prevent damage to the building exterior, the water must be properly handled. Condensate can result in problematic spilling down the side of the building, potentially causing ugly water stains and water damage along the side of a building. Water falling from heat pump units on pedestrians below is likely to result in an enforcement action from a municipal building department or damages claims by the pedestrians.

Drainage can become especially challenging, however, in the case of large, multi-unit buildings, as cold-climate heat pumps may be located well away from ground level, for example on exterior walls of a tall building. Exterior wall drainage systems, such as piping along the outside of the building, can be visually unappealing and can still result in leakage and water damage.

An alternative to drainage is vaporization of the condensate. While vaporization is feasible in terms of system installation and coordination with building infrastructure, it suffers from several drawbacks. The energy input required to vaporize the condensate (i.e. the latent heat) is significant and can reduce the system's coefficient of performance. This excess energy input can hinder the long-term economic and environmental benefits of the system over older heating technologies. The vaporization approach also adds significant cost and complexity to packaged cold-climate heat pump systems.

Typical packaged heat pumps also already include a means for vaporizing the condensate produced during cooling mode—typically the drain pan under the indoor coil is pitched to allow any condensate to flow down toward an outdoor coil. This effectively reduces the temperature of that outdoor coil, helping to increase the efficiency of the heat pump in cooling mode. So vaporization would not only decrease efficiency in heating mode, but it would also require a means for condensate to drain in two different directions, depending on the season, adding significant complexity and cost to the cold-climate heat pump units.

Another concern with the vaporization solution is indoor space conditions. Spaces today may have low relative humidity (RH) in the heating season, due to relatively high air exchange rates with the outdoors. Vaporizing the condensate inside could counteract that, adding moisture to these typically dry indoor spaces. But as building operators look for ways to reduce energy use, they seek solutions leading to spaces with increased air tightness. Reducing air exchange during heating seasons also results in less variation in indoor humidity during these seasons. Already new buildings built to the strict Passive House standards can experience wintertime humidity issues when energy recovery ventilations, which keep much of the indoor humidity inside, are utilized. Therefore, it is likely that indoor conditions in the not-too-distant future will not always benefit from increased humidity. Including a humidistat with the heat pump that would allow the condensate to be vaporized or not depending on space conditions would be one way of addressing this. However, that solution would still experience the significant energy impact of vaporization at least part of the time, and would also require a means of condensate removal for the remainder.

Thus it is often more preferable to employ a drainage solution to disposing of condensate from a cold-climate heat pump system rather than a vaporization solution. The goal of drainage solutions is to direct the water runoff into the ground or building drainage system.

It is relatively simple in new construction buildings to provide a dedicated drainage riser for the condensate from the outdoor coils of a cold-climate heat pump system within the building walls. However, there remains a need for a solution in older buildings retrofitted with cold-climate heat pump heating systems.

SUMMARY OF THE INVENTION

It is accordingly an object of the present invention to provide a solution to the current drainage challenges in older buildings retrofitted with cold-climate heat pump heating systems. The solution according to the present invention is to utilize existing piping infrastructure in older buildings to dispose of condensate from the heat pumps' outdoor coils. In older buildings that formerly utilized centrally distributed steam or hot water heating systems, for example, the present invention utilizes the piping from the old heating system to dispose of the condensate from the new cold-climate heat pump heating system.

Such central heating systems already feature a network of piping—branches, risers, and mains—that extend throughout the building, leading to all relevant spaces. The present invention's use of this existing network of piping to safely discharge the condensate from the cold-climate heat pump is advantageous over other solutions in that it does not require energy for vaporization, does not risk over-humidifying a living space, avoids unsightly and potentially problematic outdoor drainage piping, and avoids the expense of implementing a new drainage piping system throughout an older building.

The present invention's approach does, however, create certain unique challenges. First, the building's old heating system may still be active. This is likely true in a building that implements a cold-climate heat pump heat system on a unit-by-unit, room-by-room, or other space-by-space basis. In such situations, the present invention's drainage system must be capable of determining when it is and is not safe to drain condensate into the building's existing piping infrastructure and must employ a system control for allowing and restricting access to the existing infrastructure. A second challenge for the present invention's drainage approach is that the condensate from the heat pump is typically slightly acidic because it absorbs carbon dioxide from the air, creating carbonic acid. The system should preferably, therefore, reduce the acidity of the condensate before introducing it into the building's existing piping infrastructure to maintain the piping's longevity and avoid inconvenient maintenance needs in particular occupied spaces.

The present invention overcomes these challenges and utilizes a building's existing piping infrastructure to dispose of condensate from the cold-climate heat pump system with a system and device that includes a drainage pan or other, similar structure to capture condensate from the heat pump's coils and drains it into the existing piping infrastructure. The collected condensate is thereby transported through the system's condensate piping and into the building's existing piping infrastructure connected thereto. Some preferable embodiments of the present invention may also employ a P-trap to avoid any risk that the cold-climate heat pump's fan draws in air from the drainage lines and piping.

To deal with the challenges associated with a still-active legacy central heating system, the system employs means to shut off flow between the system's condensate piping and the building's existing piping infrastructure. These flow-control means can include, for example, a steam trap—for older buildings still using central steam heating systems—or one or more valves, such as motorized valves, two-way valves, etc. Those of ordinary skill in the art will recognize the various means available for controlling the flow of condensate.

In addition to the flow-control means, the system also preferably employs a system control to overcome the challenges of a building's still-active legacy heating system. The system control preferably includes one or more sensors capable of detecting the presence, temperature, pressure, etc. of any fluid in the building's existing piping infrastructure. These sensors would provide the system control with information about the building's legacy heating system and the existing piping infrastructure. Such information can indicate when it is safe to allow the system to introduce the condensate into the building's existing piping infrastructure. Preferable embodiments of the system control may also employ one or more sensors capable of detecting information about the condensate in the system, such as the amount, pH, temperature, etc.

The system control also preferably includes modules for monitoring the building's legacy heating system and existing piping infrastructure using the information from the one or more sensors and for controlling the system's interactions with the building's existing piping infrastructure. Such modules preferably monitor the pressure and/or temperature of any fluid inside the building's existing piping infrastructure using the system control's one or more sensors and determine when it is safe to allow condensate to flow from the system's condensate piping into the building's existing piping infrastructure.

For example, preferable embodiments may employ a monitoring module that monitors the information received from the system control's one or more sensors. Upon receiving information from the sensors indicating that the building's existing piping infrastructure is depressurized, the monitoring module would send a signal to a control module instructing the control module that it is now safe to allow condensate to drain from the system. The control module would then open the motorized valve or other flow-control means to allow the condensate to be expelled into the building's piping. In some preferable embodiments, the control module may keep the valve or other flow-control means open for a period of time or until all the condensate has drained from the system. In others, the monitoring module may instruct the control module to close the valve or other flow-control means upon receiving information from the system control's sensors that the building's existing piping infrastructure is heating up or becoming pressurized once again. In each situation, the system ensures efficient disposal of condensate through the building's existing piping infrastructure only when safe to do so.

Preferable embodiments of the present invention further include a condensate neutralizer to balance the pH of the condensate in the system. The condensate neutralizer would preferably include an amount of neutralizer sufficient to neutralize the pH of the condensate for an extended period of time so as to minimize maintenance. The condensate neutralizer may also include a pH sensor to measure the pH of the condensate upon entry into and/or exit from the condensate neutralizer. The condensate neutralizer is preferably implemented such that the condensate naturally enters the neutralizer during the drainage process. For example, the condensate neutralizer may accept condensate from the drainage pan before it enters the system's condensate piping, or the neutralizer may be placed between the drainage lines and the building's existing piping infrastructure to neutralize the condensate immediately before it is drained into the building piping, or the neutralizer may be placed elsewhere along the system's drainage lines where physically convenient.

In one particularly advantageous embodiment, for example, the system may collect condensate in the drainage pan, pass the condensate through the condensate piping and into the condensate neutralizer. The condensate neutralizer may then measure the condensate's pH and treat it until the acidity has been neutralized, as determined by a pH sensor in some embodiments, and then pass the condensate from the condensate neutralizer into a lower section of the condensate piping. It may then be held there until the system control determines, using its modules and sensors, that it is safe to allow the condensate to pass into the building's existing piping infrastructure. Upon this determination, the system control's modules open the valve or other flow-control means to drain the condensate into the building's existing piping infrastructure. The system control would then keep the valve or other flow-control means open until a sensor indicates that all the condensate has been drained from the system or that the building's legacy heating system has reactivated and the existing piping infrastructure is becoming re-pressurized, whichever occurs first. Such a preferable embodiment of the present invention utilizes the building's existing piping infrastructure for drainage without any effect on the functioning of the building's legacy heating system.

Preferable embodiments may further employ leak detection monitoring that indicates if the system experiences any leakage, for example at the drainage pan, flow-control means, or anywhere within the condensate piping.

As those skilled in the art will appreciate, the present invention is not limited to the embodiments and arrangements described above. Other objects of the present invention and its particular features and advantages will become more apparent from consideration of the following drawings and detailed description of the invention.

DETAILED DESCRIPTION OF THE INVENTION

Figure 1:
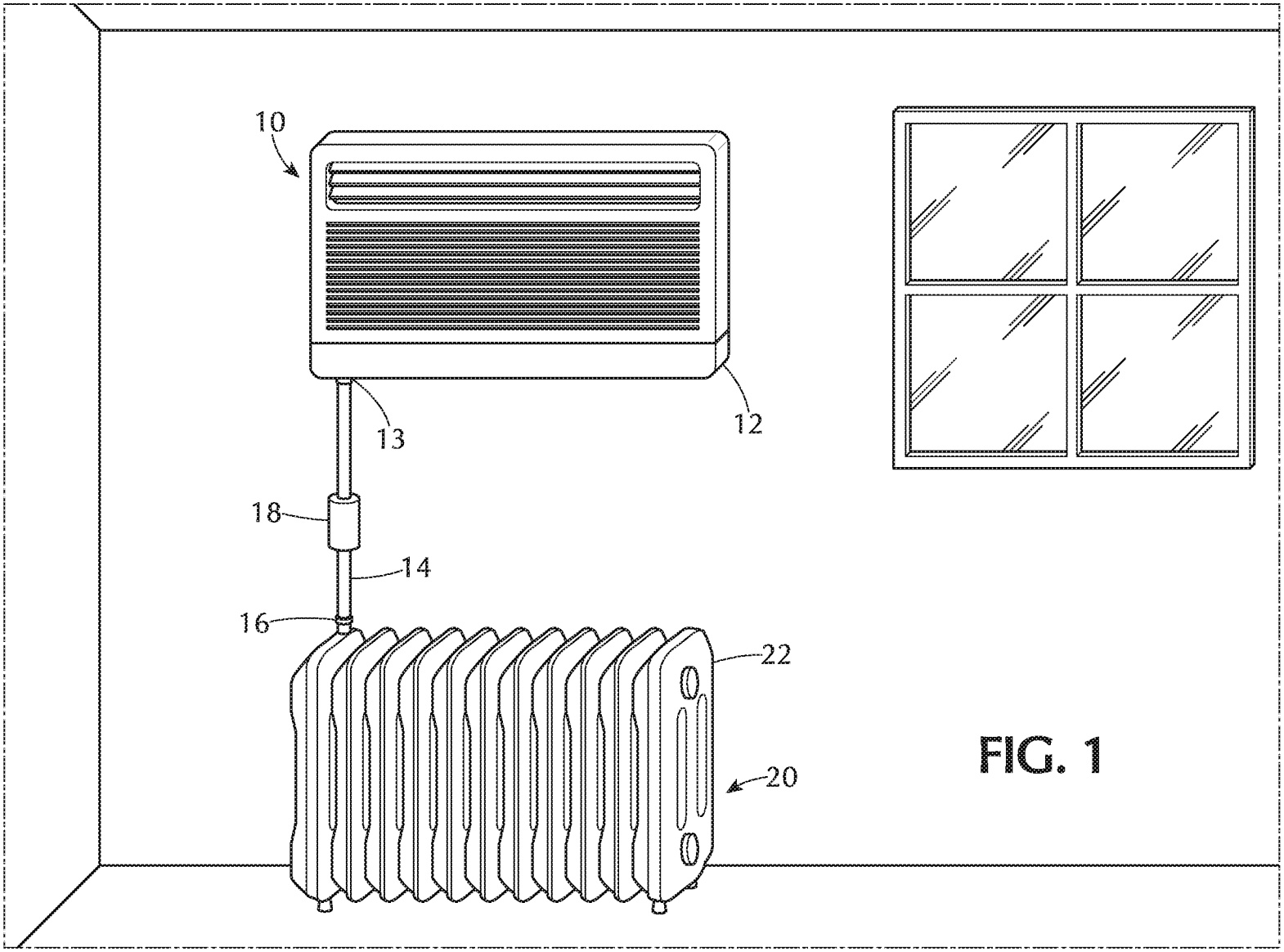
FIG. 1 is a depiction of a wall-mounted heat pump internal heating unit with its drainage line connecting to a steam radiator via a vent valve according to exemplary embodiments of the present invention.

The following detailed description illustrates the technology by way of example, not by way of limitation of the principles of the invention. This description will enable one skilled in the art to make and use the technology, and describes several embodiments, adaptations, variations, alternatives and uses of the invention, including what is presently believed to be the best mode of carrying out the invention. One skilled in the art will recognize alternative variations and arrangements, and the present technology is not limited to those embodiments described hereafter.

The present invention provides a system for draining condensate from the coils of a cold-climate heat pump heating system 10 into the existing piping infrastructure 20 of a building. The invention operates by collecting the condensate and introducing it into the building's piping 20 in a controlled manner to ensure that system does not affect the building's legacy heating systems. Preferable embodiments include a drainage pan 12 having a drainage hole 13, condensate piping 14 connected to the drainage hole 13 and the legacy heat piping 20.

Condensate piping 14 may be any suitable conduit permitting fluid flow therein, and may include essentially any tubing, hose or rigid piping used in construction, manufacturing or laboratory. For example, tubing may be PVC tubing, polyethylene tubing, polypropylene tubing, polyurethane tubing, fluoropolymer tubing, silicone tubing, etc. Tubing may also be steel tubing including mild steel or stainless steel tubing. Hose may be any tubing reinforced with metal wire or synthetic or natural fiber or threads. Piping may be plastic pipe or metal pipe. The particular type and material to be used for condensate piping 14 will be determined by expected heat and pressure from legacy heat piping 20 that the condensate piping 14 will be exposed to and by considerations of cost and installation convenience.

Flow-control means 16 are provided in condensate piping 14 between the drainage hole 13 and the legacy heat piping infrastructure 20. Flow control means 16 is any type of liquid flow controller, and may include one or more of: two-way flow-control valves, one-way flow-control valves, and traps. Two-way flow-control valves include: gate valves, knife valves, needle valves, pinch valves, piston valves, plug valves, ball valves, globe valves, butterfly valves, choke valves, spool valves, diaphragm valves. A pinch valve may be used where condensate piping 14 comprise flexible tubing and a compression/clamping mechanism is provided to close or seal the tubing by squeezing it. One-way valves include a check valve, such as a ball check valve. Preferably, the flow control means 16 is a motorized or solenoid controlled gate valve. The flow control means 16 is controlled by a system control that instructs the motorized or solenoid controlled valve to open and close based on the status of the building's existing piping infrastructure 20. Traps such as a P-trap or steam trap may be used instead of a valve but are less preferred due to the less direct control provided.

Preferable embodiments of the system control employ one or more sensors to monitor the building's legacy heating system and existing piping infrastructure 20. Sensors may include temperature sensors, pressure sensors, fluid-level sensors, pH sensors, etc. Sensors performing these functions may be discrete or a single sensor may perform multiple functions. Preferable embodiments keep track of the temperature and pressure of fluids in the building's existing piping infrastructure 20 as well as the levels and pH of condensate in the condensate piping 14. The system control uses this information to determine when and how long to open the flow-control means 16 to allow the condensate to flow into the building's piping infrastructure 20. Some preferable embodiments may also employ additional sensors to monitor the system for leaks and clogs, facilitate preventative maintenance, etc.

The present invention may employ different configurations in order to address the disparate needs of installation into an existing steam heating system or hydronic system. In preferable embodiments configured for steam systems, the system may include a steam trap or valve to prevent any errant steam in the returns from escaping and causing issues at the relevant heat pump 10. Alternatively, said steam trap or valve 16 may be field-installed, as may be indicated in the installation manual. This allows the conversion of existing steam-heated buildings over to heat pumps in phases.

Indeed, one of the advantages of the present invention is that it allows the installation of cold-climate heat pumps on a unit-by-unit, room-by-room, or other space-by-space basis. This allows a large building with several separate units, for example, to update its heating system incrementally over time. The invention facilitates such a piecemeal approach by preventing fluid from the building's legacy heating system's return piping 20 from inadvertently entering the cold-climate heat pump's condensate piping 14.

For example, for preferable embodiments installed in a building using a centralized steam heating system, the flow-control means 16 would be controlled to be normally closed and instructed to open only when there is sufficient heat pump condensate volume requiring removal and the steam return lines 20 are either (1) relatively cool or (2) not pressurized, as determined by the system control's sensors, in order to ensure that any steam present in return pipes 20 does not inadvertently enter the heat pump condensate piping 14. In this situation, a safety signal could be sent to temporarily shut off the heat pump 10 should condensate discharge become too great until sensors confirm that there is no steam present in return lines 20 and condensate present in the system can be drained. It should be obvious to those versed in the state of the art that a variety of different electronic and mechanical sensor types including, but not limited to, a temperature sensor mounted on the return piping could be used to provide a signal to the control valve that steam return lines are either (1) relatively cool or (2) not pressurized. It should be obvious to those versed in the state of the art that a variety of different electronic and mechanical sensor types including, but not limited to, float type sensors could be used to provide a signal to the motorized valve indicating that a sufficient volume of condensate needs to be discharged.

In buildings where the existing steam system is operated continuously or nearly continuously during the heating season, it may be difficult to discharge condensate into existing steam lines 20. In such instances, the proposed innovation could be integrated with a sequence of operations control change to the steam boiler plant such that the central steam supply is shut-off for an appropriate number of minutes of every hour to provide sufficient time for heat pump condensate drainage. The frequency of this shut off period could vary based on outdoor temperature or other building factors. It should be obvious to those trained in the state of the art that communication signals from disparate heat pump condensate sensors could be incorporated as an input into a steam plant controller to ensure adequate condensate drainage time while not adversely impacting overall steam operation. In such an application, space temperature sensors throughout a building could also provide feedback to inform such a modified sequence of operations that takes advantage of building thermal mass to ensure that brief disruptions in either steam distribution or heat pump operation do not adversely impact thermal comfort.

Preferred embodiments also include a P-trap or other means to provide an air break between the heat pump fan and the plumbing system. Air-break means other than a P-trap may include a separate piece of the installation, indicated as such in the installation manual, or other approaches as will be known to those of ordinary skill in the art. The P-trap or other air-break means help to prevent the heat pump fan from drawing in air from the condensate piping. Use of a P-trap or other air-break means is generally standard practice for any drainage pan used in air-handling equipment, as will be recognized by those of ordinary skill in the art.

Preferable embodiments of the invention also protect existing piping infrastructure 20 by neutralizing the acidity of the condensate (increasing the pH) before it is introduced into the existing piping. The system uses a condensate neutralizer 18 to do so. A condensate neutralizer is a hollow tube or container which is open at both ends and is installed in-line in the condensate piping 14. The condensate neutralizer is filled with media which raises the pH of the condensate, neutralizing condensate acids. Those of ordinary skill in the art will be aware of such neutralizer media, which include substances with a high pH (aka basic substances) such as sodium hydroxide, ammonium hydroxide, calcium hydroxide, commonly known as lime, and the like. The condensate neutralizer 18 will preferably contain sufficient neutralizer media to last long enough so as to avoid inconvenient maintenance needs in occupied spaces. The amount of neutralizer in the device should be sufficient to cover at least one winter's worth of condensate, for example, to operate for a year, etc.

Referring now to FIG. 1, a wall mounted heat pump 10 is depicted with its drainage system connected to the legacy heat piping infrastructure 20 in a location that previously used a centralized steam heating system. As seen in FIG. 1, the condensate from the heat pump's coils is accumulated in the drainage pan 12 and fed into the condensate piping 14.

Preferable embodiments employ a condensate neutralizer 18, which treats the condensate with neutralizer to reduce the acidity. The condensate neutralizer 18 helps to preserve the building's legacy heat piping infrastructure 20 and prevent added maintenance. Preferable embodiments of the condensate neutralizer 18 contain sufficient neutralizer to treat the condensate for an extended period of time to avoid unwanted intrusions in the unit. In some embodiments, the condensate neutralizer 18 may additionally employ a pH sensor to signal when the condensate has been neutralized and can be released into the remaining drainage system, a neutralizer-refill sensor, etc.

Upon exiting the condensate neutralizer 18, as depicted in FIG. 1, the condensate flows through the condensate piping 14 and down into the building's legacy heat piping infrastructure 20. Preferable embodiments employ flow-control means 16, in the form of a steam trap, valve, or otherwise, to prevent the condensate from entering the building's legacy heat piping infrastructure 20 until it is safe to do so. In the embodiment depicted in FIG. 1, the condensate drains into the building's old steam radiator 22, still present in the room, though inactive, through a vent valve provided in the steam radiator 22. The condensate can thus pass through the old steam radiator 22 and into the building's legacy heat piping infrastructure 20 for removal.

Figure 2:
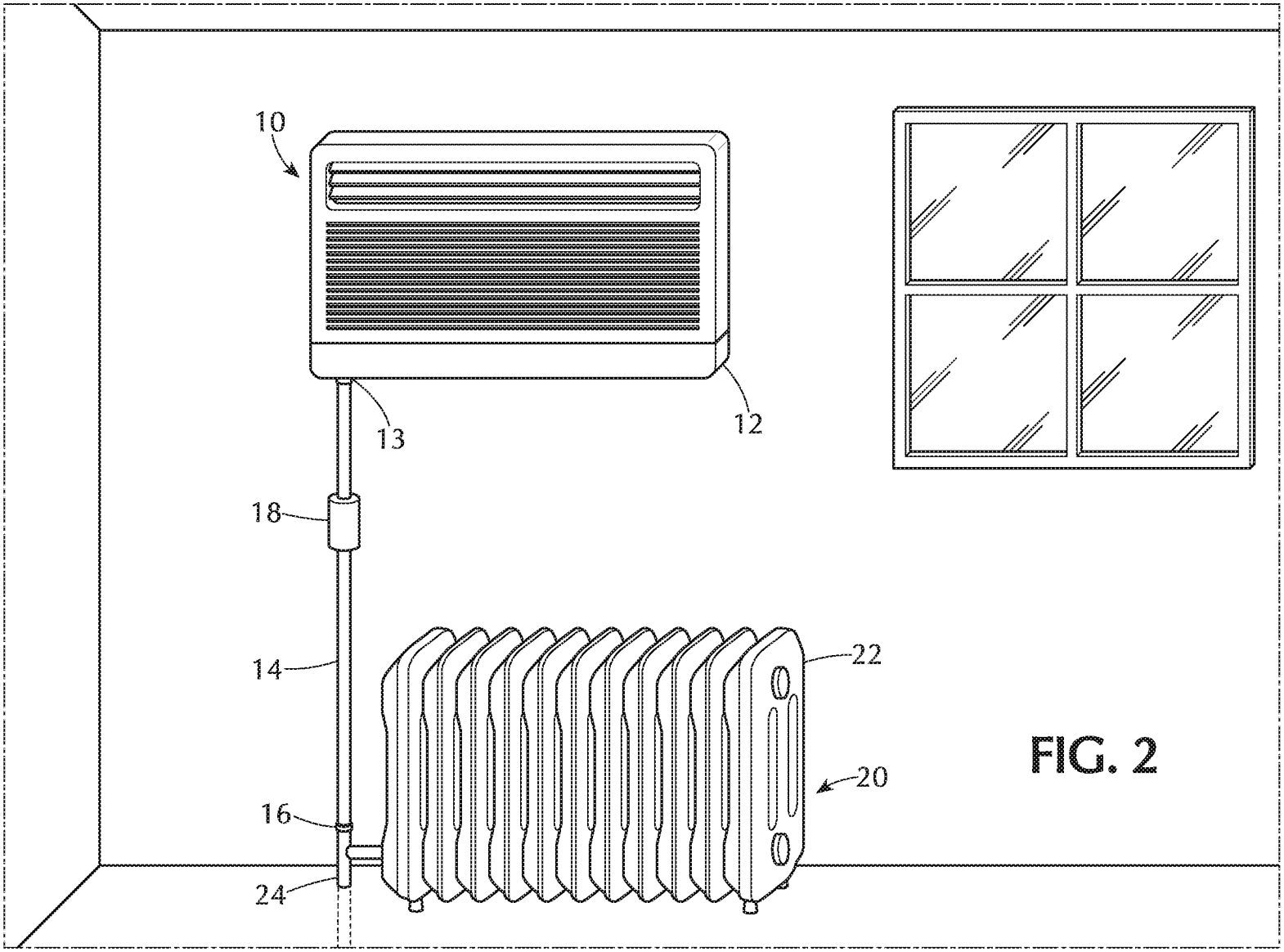
FIG. 2 is a depiction of a wall-mounted heat pump internal heating unit with its drainage line connecting to a steam radiator's inlet/outlet piping according to the exemplary embodiments of the present invention depicted in FIG. 1.

Referring next to FIG. 2, a wall mounted heat pump 10 is likewise depicted with its drainage system connected to the legacy heat piping infrastructure 20 in a location that previously used a centralized steam heating system. The difference between FIGS. 1 and 2 is the heat pump's drainage system is connected to the old steam radiator's inlet/outlet piping 24 via a valve 16 in FIG. 2, rather than to the steam radiator itself as in FIG. 1. Again, in the embodiment depicted in FIG. 2, the condensate is collected in the drainage pan 12, fed into the condensate piping 14, filtered through the condensate neutralizer 18, and drained into the building's legacy heat piping infrastructure 20 via the steam radiator's inlet/outlet 24. Preferable embodiments again employ flow-control means 16 to ensure safe disposal of the condensate through the legacy piping 20.

Figure 3:
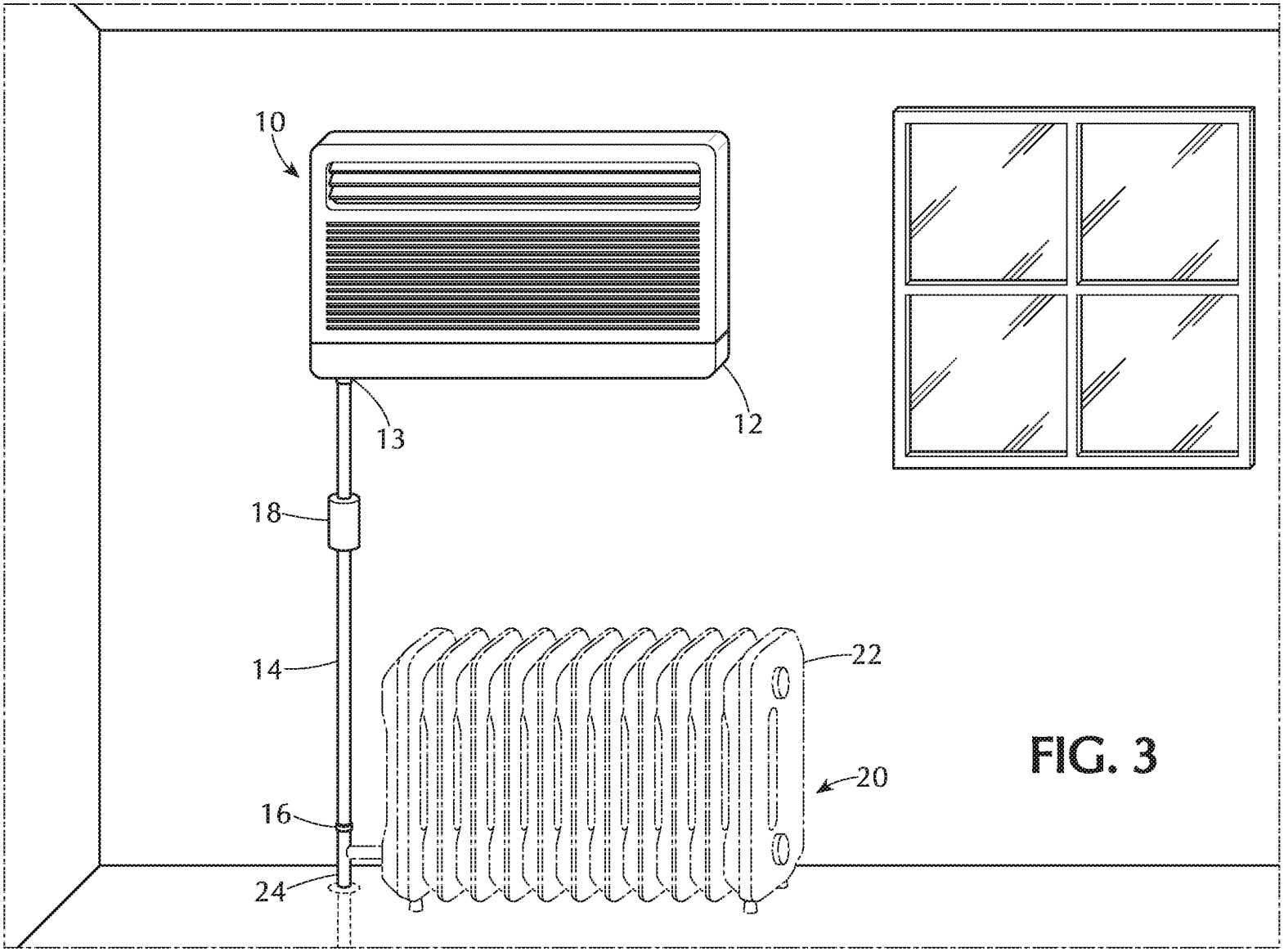
FIG. 3 is a depiction of a wall-mounted heat pump internal heating unit with its drainage line connecting to the sub-floor legacy heat piping infrastructure in a location in which the old steam radiator (depicted with dotted lines) has been removed according to the exemplary embodiments of the present invention depicted in FIGS. 1-2.
Figure 4:
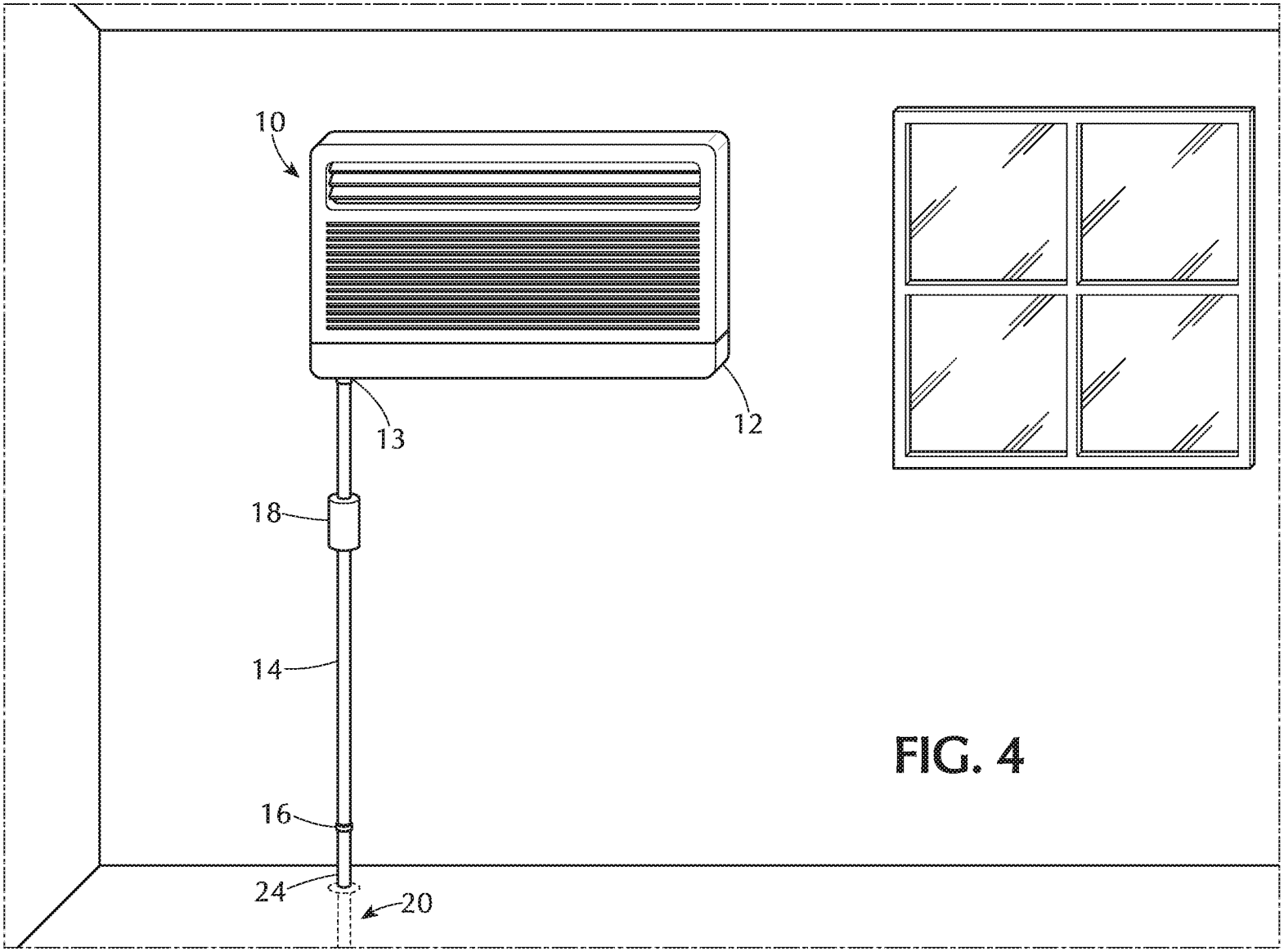
FIG. 4 is a depiction of a wall-mounted heat pump internal heating unit with its drainage line connecting to the sub-floor legacy heat piping infrastructure in a location in which the old steam radiator (no longer depicted) has been removed according to the exemplary embodiments of the present invention depicted in FIGS. 1-3.

Referring now to FIG. 3, a wall mounted heat pump 10 is again depicted with its drainage system connected to the legacy heat piping infrastructure 20 in a location that previously used a centralized steam heating system. In FIG. 3, the old steam radiator 22 has been removed, and the condensate is drained directly into the sub-floor piping 20 from the legacy heating system. As in previous figures, the condensate is thus collected in the drainage pan 12, fed into the condensate piping 14 and through the condensate neutralizer 18, and drained into the legacy heat piping infrastructure 20 when the flow-control means 16 are open, as controlled by the control system. FIG. 4 depicts the same process, however in FIG. 4 the old steam radiator 22 is not depicted at all and in FIG. 3 the old steam radiator 22 has been removed but its old location is shown with dotted lines.

Figure 5:
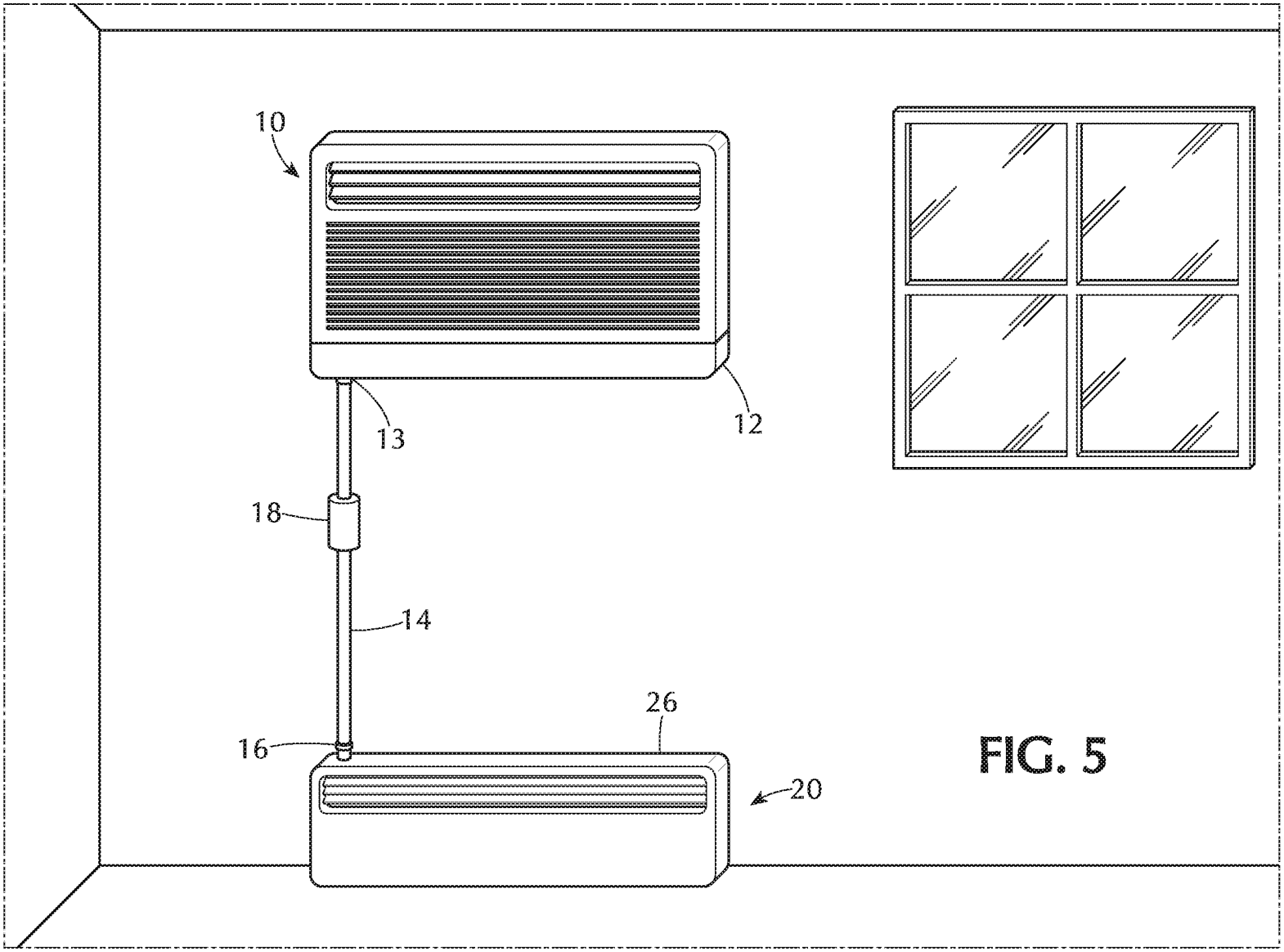
FIG. 5 is a depiction of a wall-mounted heat pump internal heating unit with its drainage line connecting to a baseboard radiator's outlet piping via a valve, the baseboard radiator still being present but inactive, according to the exemplary embodiments of the present invention depicted in FIGS. 1-4.

Referring next to FIG. 5, a wall mounted heat pump 10 is depicted with its drainage system connected to the legacy heat piping infrastructure 20 in a location that previously used a centralized hot-water heating system. FIG. 5 shows the present invention's accumulation of condensate in the drainage pan 12, through which it is fed into the condensate piping 14 and through the condensate neutralizer 18, and drains this time into the building's legacy heat piping infrastructure 20 through the old baseboard radiator's outlet piping. In the embodiment depicted in FIG. 5, the old baseboard radiator 26 is still present in the unit, though inactive. Indeed, the system of the present invention works best in buildings that previously employed hot-water heating systems if the entire building is updated with in-unit heat pump heating systems at once (or at least riser by riser), rather than incrementally unit by unit. Preferable embodiments would be implemented by removing the old baseboard radiator 26 entirely, as will be discussed in relation to FIGS. 6-8 below, but it is possible to leave the baseboard radiator 26 in place as well, as depicted in FIG. 5.

Figure 6:
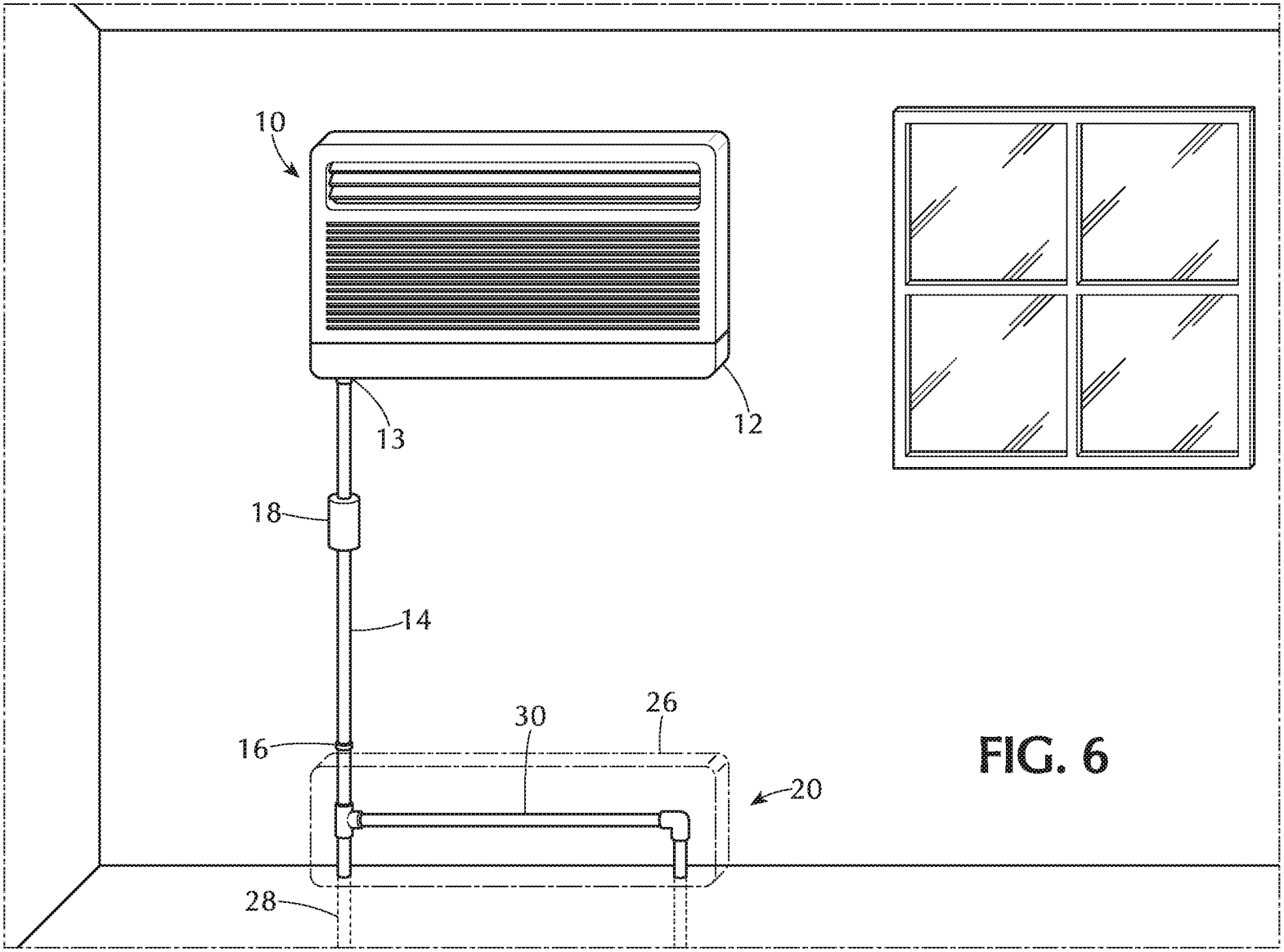
FIG. 6 is a depiction of a wall mounted heat pump internal heating unit with its drainage line connecting to a baseboard radiator's outlet piping via a valve, the baseboard radiator (depicted with dotted lines) having been removed but the baseboard radiator pipe still being present but inactive, according to the exemplary embodiments of the present invention depicted in FIGS. 1-5.

Referring now to FIG. 6, a wall mounted heat pump 10 is again depicted with its drainage system connected to the legacy infrastructure in a location that previously used a centralized hot-water heating system. In FIG. 6, the baseboard radiator 26 has been removed (its previous location depicted with dotted lines) and the condensate piping 14 is connected to the old radiator's outlet piping 28. While the baseboard radiator has been removed in the system's embodiment depicted in FIG. 6, the baseboard radiator's internal flow pipe 30 is still present. The entire baseboard radiator 26 can also be removed in preferable embodiments of the present invention, but the radiator's internal pipe 30 may be left as depicted in FIG. 6 without affecting the utility of the present invention.

Figure 7:
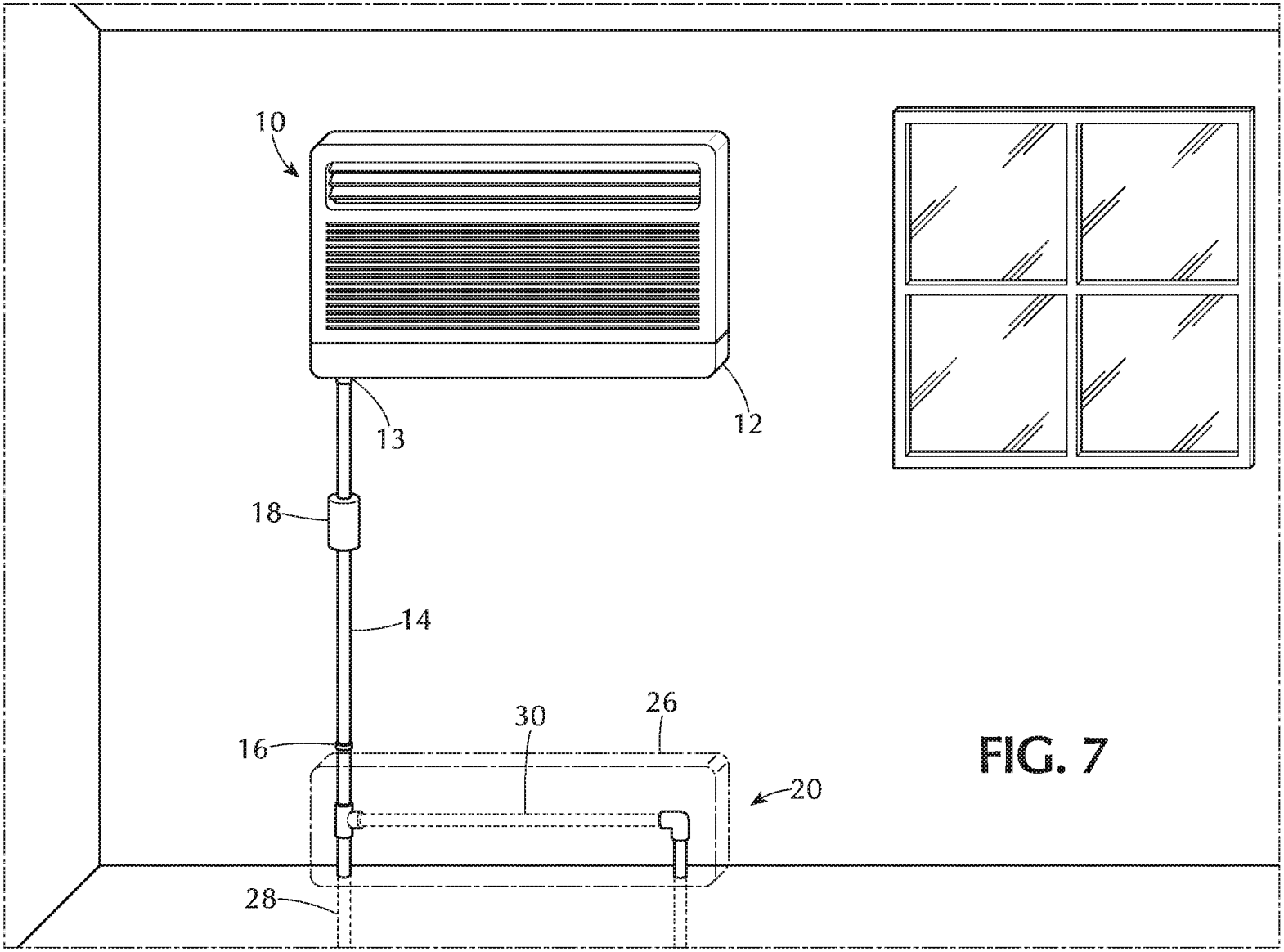
FIG. 7 is a depiction of a wall mounted heat pump internal heating unit with its drainage line connecting to the in-wall legacy heat piping infrastructure in a location in which the old baseboard radiator and in-unit pipe (depicted with dotted lines) have been removed according to the exemplary embodiments of the present invention depicted in FIGS. 1-6.
Figure 8:
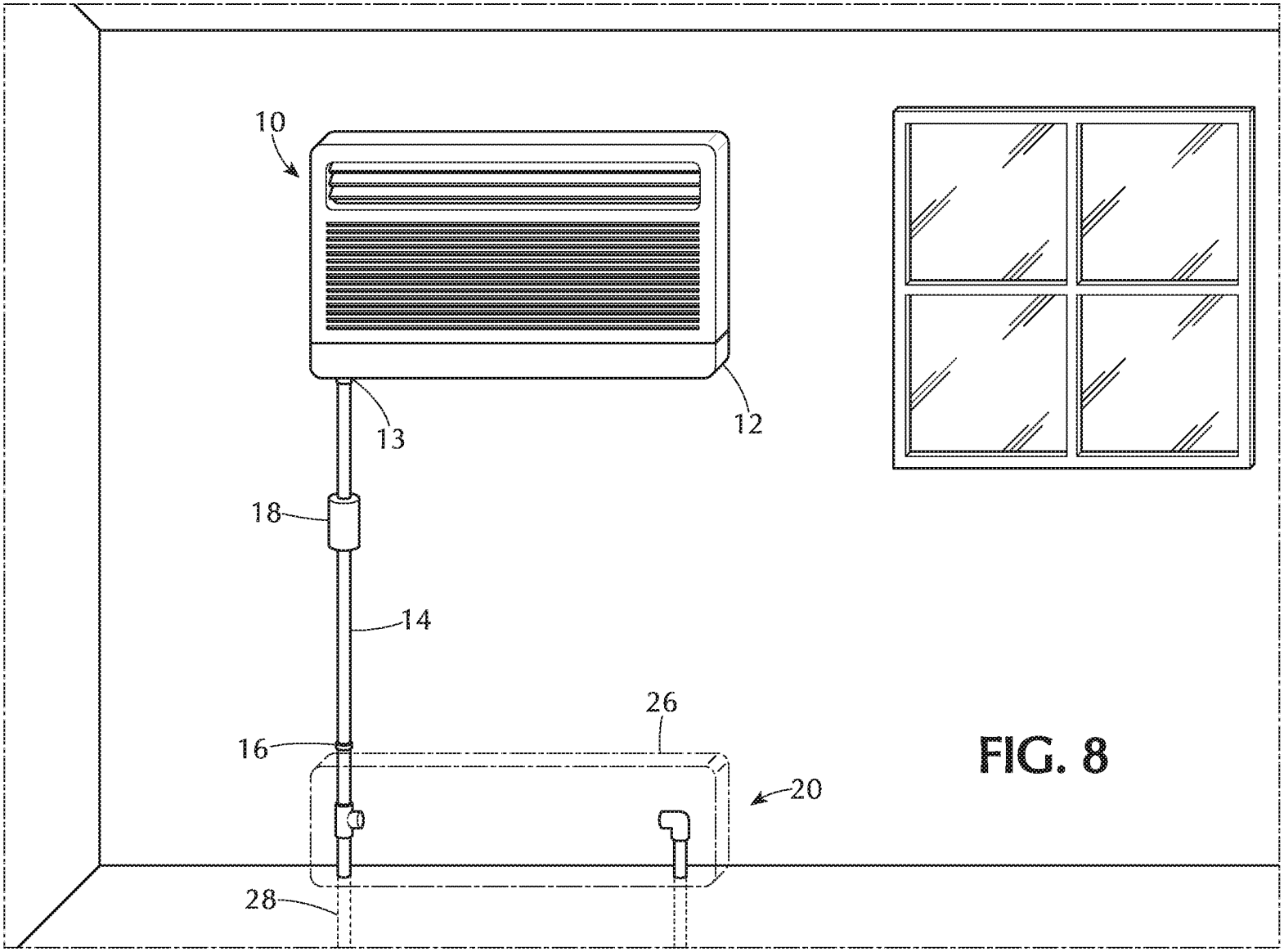
FIG. 8 is a depiction of a wall mounted heat pump internal heating unit with its drainage line connecting to the in-wall legacy heat piping infrastructure in a location in which the old baseboard radiator and in-unit pipe (no longer depicted) have been removed according to the exemplary embodiments of the present invention depicted in FIGS. 1-7.

Referring next to FIG. 7, a wall mounted heat pump 10 is depicted with its drainage system connected to the legacy heat piping infrastructure 20 in a location that previously used a centralized hot-water heating system. In FIG. 7, the baseboard radiator 26 and its internal piping 30 have been removed entirely (their previous location depicted with dotted lines) and the condensate piping 14 is connected to the building's legacy heat piping infrastructure 20 through the in-wall piping that previously connected to the baseboard radiator's outlet piping 28. FIG. 7 depicts the preferable embodiment of the present invention as used in building's that previously employed centralized hot-water heating systems, in which the in-unit baseboard radiator 26 and piping 30 have been removed and the condensate is drained directly into the in-wall legacy piping 20. FIG. 8 depicts the preferable embodiment without the old baseboard radiator represented with dotted lines, as is the case in FIG. 7.

Figure 9:
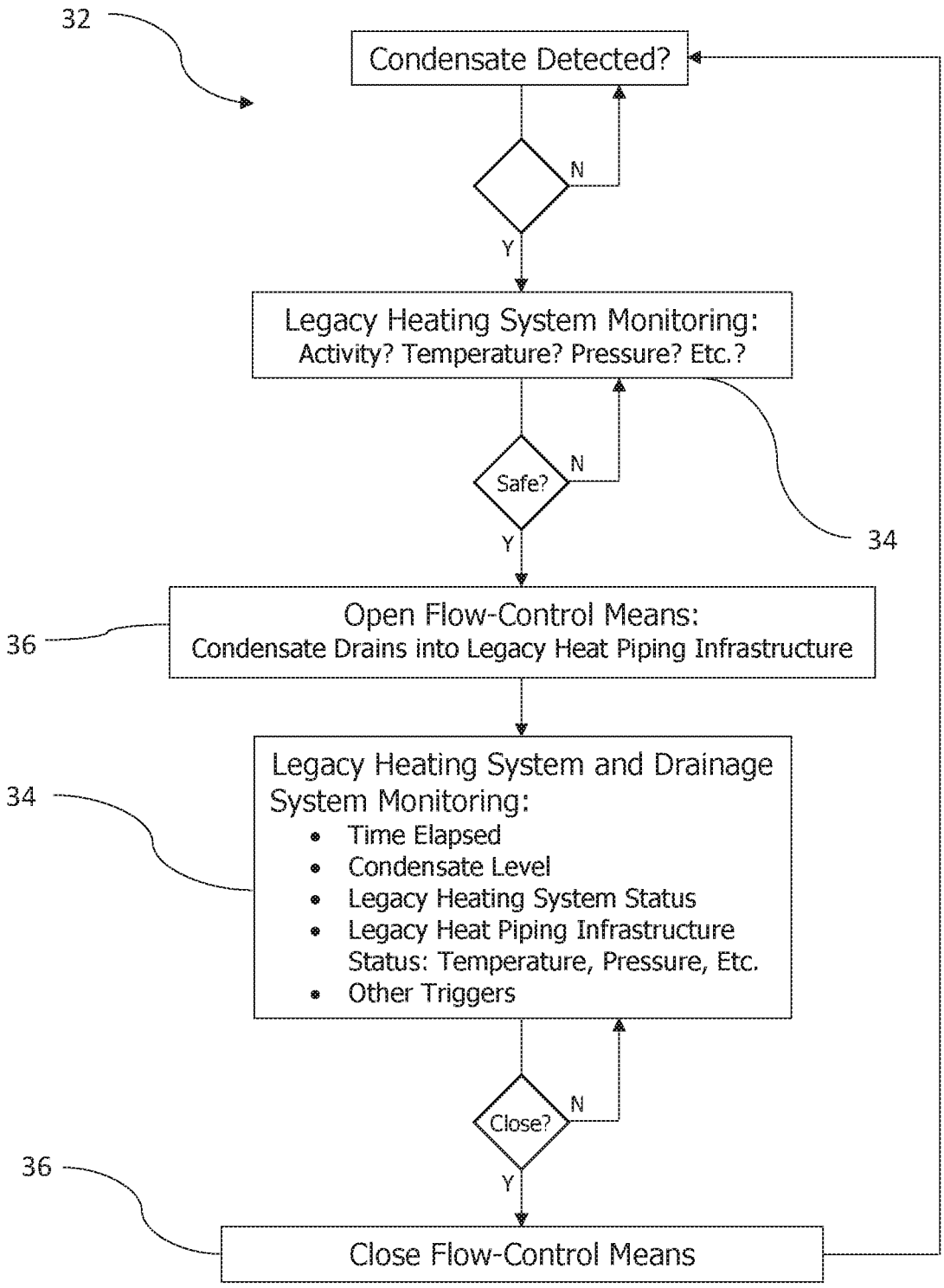
FIG. 9 is a schematic illustration of the present invention's system control managing the drainage of condensate from a wall mounted heat pump into a building's legacy heat piping infrastructure according to the exemplary embodiments of the present invention depicted in FIGS. 1-8.

Referring finally to FIG. 9, the present invention's system control 32 process is illustrated schematically. Preferable embodiments first determine if there is condensate in the system requiring drainage. This determination is preferably made using the control system's sensors. The control system 32 may employ a single sensor or any number of sensors to perform its tasks. In some preferable embodiments, therefore, the system control 32 employs a fluid-level sensor that checks for the presence and level of fluid in the drainage system. The system control 32 may wait until the condensate in the system reaches a threshold level or may initiate the drainage sequence any time it detects condensate in the system at all. In preferable embodiments, a monitoring module 34 monitors both the legacy heat piping infrastructure 20 and the drainage system to determine when to drain the accumulated condensate.

Upon determining the system contains condensate requiring drainage, the system control 32 preferably checks the building's legacy heat piping infrastructure 20 to determine if it is safe to drain the condensate. For example, in the case where a building is still using a central steam heating system but certain units have been outfitted with in-unit heat pump 10 heating systems, it is important to determine that the legacy piping 20 is not pressurized when draining the condensate, as releasing the condensate into the legacy piping 20 while pressurized could result in back flow of steam into the drainage system and damage to the heat pump heating unit 10. To avoid such a scenario, the system control 32 preferably employs the monitoring module 34 to monitor the legacy heat piping infrastructure 20 and the legacy heating system to determine when the system is active and the infrastructure 20 is pressurized. The monitoring module 34 preferably does so using the system control's one or more sensors. Preferable embodiments employ one or more sensors to detect the activity of the legacy heating system, as well as the presence, temperature, pressure, etc. of any fluid in the legacy heat piping infrastructure 20.

Upon determining that it is safe to drain any accumulated condensate in the system into the building's legacy heat piping infrastructure 20, preferable embodiments instruct the system control's monitoring module 34 to generate and send a signal to the system control's control module 36, instructing the control module 36 to open the flow-control means 16 to allow accumulated condensate to drain into the legacy heat piping infrastructure 20. Recall that the flow-control means 16 may include steam traps, butterfly valves, ball valves, etc., either alone or in combination. Those of ordinary skill in the art will recognize the available flow-control means 16, all of which are useable with preferable embodiments of the present invention.

Once the flow-control means 16 is opened, any accumulated condensate in the drainage system can drain into the building's legacy heat piping infrastructure 20 for disposal. The flow-control means 16 preferably remain open at least until all accumulated condensate has been drained. Some preferable embodiments will keep the flow-control means 16 open until all condensate has drained from the system and then close the flow-control means 16. Some embodiments may keep the flow-control means 16 open even after all condensate has been drained until receiving a signal to close the flow-control means 16 for some other reason, for example upon a determination that the legacy heat system has become reactivated, the legacy heat piping infrastructure 20 has begun to re-pressurize and/or reheat, and/or that the legacy heat piping infrastructure 20 has reached a threshold temperature and/or pressure level. Some embodiments may close the flow control means 16 if the amount of condensate in the drainage system reaches a threshold level. Some embodiments may close the flow-control means 16 after a set period of time. Other triggers for closing the flow-control means 16 are possible as well, including for example a determination that system maintenance is required, etc. As will be understood by those of ordinary skill in the art, any of these triggers for closing the flow-control means 16 may be considered in combination, and the system control 32 may create a hierarchy of triggers to determine when to close the flow-control means 16.

For example, in particularly cold climates and/or during particularly cold periods of time, a building's legacy heating system may be running almost continuously. In such scenario, any in-unit heat pump 10 may be likewise running almost continuously, thereby generating a lot of condensate requiring drainage. In such scenarios, opportunities to drain accumulated condensate may be few and far between, and the need to drain condensate increases. Accordingly, preferable embodiments of the system control 32 will have a way of dealing with such a scenario. One particularly preferable embodiment may turn off one or more particular in-unit pumps 10 to avoid overflow of the drainage system and potential leakage and water damage. Other particularly preferable embodiments may turn off the building's legacy heating system for a brief period of time to allow in-unit heat pump 10 systems an opportunity to drain. In still other embodiments, the system may resort to back-up in unit drainage processes for the heat pump units, whether manual, automated, or otherwise. Other modes of dealing with particularly problematic drainage scenarios will be ascertainable to those of ordinary skill in the art.

Whatever factors are used to determine whether and when to close the flow-control means 16, preferable embodiments of the system control's monitoring system 34 receive information for making that determination from the system control's one or more sensors. Upon concluding that the flow-control means 16 should be closed by monitoring the information from the one or more sensors, the monitoring module 34 sends a signal to the control module 36 to close the flow-control means 16, in preferable embodiments. The control module 34 can preferably open and close the flow-control means 16 through electronic and mechanical means without human interaction. Such automation adds to the system's efficiency and convenience, accomplishing certain objectives of the present invention.

While the present invention has been described with reference to particular embodiments and arrangements of parts, features, and the like, it is not limited to these embodiments or arrangements. Indeed, modifications and variations included in these teachings will be ascertainable to those of skill in the art.

What is claimed is:

1. A drainage system for disposing of condensate from the coils of a heat pump, comprising:

a drainage pan having a drain hole therein;

condensate piping connecting the drain hole to legacy heat piping;

flow-control means provided with the condensate piping between the drain hole and the legacy heat piping, the flow-control means being capable of: an open state to allow a flow of condensate from the drainage pan to the legacy heat piping; and a closed state to prevent a flow of condensate from the coils of a heat pump from the drainage pan to the legacy heat piping and to prevent a reverse flow of fluid from the legacy heat piping to the drainage pan;

a drainage system control unit having at least one sensor, a monitoring module and a control module, the monitoring module monitoring a status of the drainage system and a status of the legacy heat piping, the control module controlling the open state and the closed state of the flow-control means, the at least one sensor comprising one or more electronic devices for determining and transmitting sensor data regarding one or more of (a) a fluid level of the drainage pan, (b) a fluid level of the condensate piping, (c) a pH reading of fluid in the condensate piping, (d) an activation status of a legacy heating system associated with the legacy heat piping, (e) a presence of fluid in the legacy heat piping, (f) a fluid level in the legacy heat piping, (g) a temperature of fluid in the legacy heat piping, (h) a pressure in the legacy heat piping, or (i) time elapsed since the flow-control means was last opened or closed; and the control module receiving the sensor data and controlling the open state and the closed state of the flow-control means in response to the sensor data.

2. The system of claim 1, wherein the monitoring module sends a signal to the control module to open the flow-control means after the flow-control means have been closed for a predetermined period of time.

3. The system of claim 1, wherein the monitoring module sends a signal to the control module to close the flow-control means after the flow-control means have been open for a predetermined period of time.

4. The system of claim 1, wherein the monitoring module sends a signal to the control module to open the flow-control means if the sensor transmits sensor data to the monitoring module indicating that the fluid level of the drainage pan or the fluid level of the condensate piping has reached an upper threshold limit.

5. The system of claim 1, wherein the monitoring module sends a signal to the control module to open the flow-control means if the sensor transmits sensor data to the monitoring module indicating that the legacy heating system is inactive.

6. The system of claim 1, wherein the monitoring module sends a signal to the control module to close the flow-control means if the sensor transmits sensor data to the monitoring module indicating that the legacy heating system is active.

7. The system of claim 1, wherein the monitoring module sends a signal to the control module to close the flow-control means if the sensor transmits sensor data to the monitoring module indicating that the fluid level of the legacy heat piping has reached an upper threshold limit.

8. The system of claim 1, wherein the monitoring module sends a signal to the control module to close the flow-control means if the sensor transmits sensor data to the monitoring module indicating that the temperature of the legacy heat piping has reached a temperature limit.

9. The system of claim 1, wherein the monitoring module sends a signal to the control module to close the flow-control means if the sensor transmits sensor data to the monitoring module indicating that the pressure of the legacy heat piping has reached an upper threshold limit.

10. The system of claim 1, further comprising a condensate neutralizer containing an acid neutralizing media provided with the condensate piping between the drain hole and the legacy heat piping.

11. The system of claim 10, further comprising a pH sensor provided with the condensate piping between the condensate neutralizer and the legacy heat piping.

12. The system of claim 11, wherein the monitoring module sends a signal to the control module to open the flow-control means only if the pH sensor transmits pH sensor data to the monitoring module indicating that the pH of condensate in the condensate piping is greater than a pH lower limit.

13. The system of claim 12, wherein the monitoring module sends a signal to the control module to open the flow-control means only if the pH reading of the fluid in the condensate piping is 5 or greater.

14. The system of claim 1, wherein the flow-control means is a motorized-, thermostatic-, or solenoid-controlled two-way valve.

15. The system of claim 1, wherein the flow-control means is a motorized-, thermostatic-, or solenoid-controlled one-way valve.

16. A kit for a heat pump for disposing of condensate from the heat pump, comprising:

condensate piping, for connecting a drain hole in a heat pump drainage pan to legacy heat piping;

flow-control means capable of: an open state to allow a flow of condensate from the heat pump drainage pan to the legacy heat piping via the condensate piping; and a closed state to prevent a flow of condensate from the coils of a heat pump from the drainage pan to the legacy heat piping via the condensate piping, and to prevent a reverse flow of fluid from the legacy heat piping to the drainage pan via the condensate piping;

a drainage system control unit having at least one sensor, a monitoring module and a control module, the monitoring module monitoring a status of the drainage system and a status of the legacy heat piping, the control module controlling the open state and the closed state of the flow-control means, the at least one sensor comprising one or more electronic devices for determining and transmitting sensor data regarding one or more of (a) a fluid level of the drainage pan, (b) a fluid level of the condensate piping, (c) a pH reading of fluid in the condensate piping, (d) an activation status of a legacy heating system associated with the legacy heat piping, (e) a presence of fluid in the legacy heat piping, (f) a fluid level in the legacy heat piping, (g) a temperature of fluid in the legacy heat piping, (h) a pressure in the legacy heat piping, or (i) time elapsed since the flow-control means was last opened or closed; and the control module receiving the sensor data and controlling the open state and the closed state of the flow-control means in response to the sensor data.

17. The kit of claim 16 further comprising a condensate neutralizer containing an acid neutralizing media for installation in the condensate piping between the drain hole and the legacy heat piping.

18. The kit of claim 17, further comprising a pH sensor for installation in the condensate piping between the condensate neutralizer and the legacy heat piping.

19. The system of claim 1, wherein the flow-control means is a motorized-, thermostatic-, or solenoid-controlled two-way valve.

20. The system of claim 1, wherein the flow-control means is a motorized-, thermostatic-, or solenoid-controlled one-way valve.

* * * * *